US008534572B2

(12) United States Patent
Kah, Jr.

(10) Patent No.: US 8,534,572 B2
(45) **Date of Patent: *Sep. 17, 2013**

(54) SPRINKLER TO TOP RISER AND HOUSING SEAL CARTRIDGE FOR GEAR DRIVE SPRINKLER

(76) Inventor: Carl L. C. Kah, Jr., North Palm Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/726,891

(22) Filed: Mar. 18, 2010

(65) Prior Publication Data

US 2010/0170963 A1 Jul. 8, 2010

Related U.S. Application Data

(63) Continuation of application No. 11/438,621, filed on May 22, 2006, now Pat. No. 7,708,209.

(60) Provisional application No. 60/682,994, filed on May 20, 2005.

(51) Int. Cl.
*B05B 15/02* (2006.01)

(52) U.S. Cl.
USPC ..... 239/123; 239/115; 239/205; 239/206; 239/237; 239/240; 239/DIG. 4; 277/549; 277/562; 285/110; 285/302; 92/168

(58) Field of Classification Search
CPC ..... B05B 3/04; B05B 3/16; B05B 15/02; B05B 15/10
USPC ..... 239/114, 115, 123, 203–206, 237, 239/240–242, DIG. 4; 277/549, 558, 562, 277/577; 285/110, 302; 92/87, 168
See application file for complete search history.

(56) References Cited

U.S. PATENT DOCUMENTS

| | | | | |
|---|---|---|---|---|
| 4,316,579 | A * | 2/1982 | Ray et al. | 239/123 |
| 4,682,732 | A * | 7/1987 | Walto | 239/123 |
| 4,834,289 | A * | 5/1989 | Hunter | 239/205 |
| 5,964,408 | A * | 10/1999 | Musson | 239/123 |
| 6,082,632 | A * | 7/2000 | Clark et al. | 239/205 |
| 7,708,209 | B2 * | 5/2010 | Kah, Jr. | 239/205 |

* cited by examiner

*Primary Examiner* — Steven J Ganey
(74) *Attorney, Agent, or Firm* — Ostrolenk Faber LLP

(57) ABSTRACT

A riser seal cartridge for an irrigation sprinkler. The cartridge is formed of a rigid self support shell, and a sealing member formed of a resilient material covering the shell in areas which provide the seal. The sealing member includes a first portion which seals the top end of the sprinkler body, a second portion which seals an outer surface of the riser, a third portion which connects the first and second portions, and a fourth portion extending from the third seal portion which provides a seal for the support shell lower end portion. The first seal portion provides a high pressure seal to prevent leakage when the riser is in a fully extended position; and the second seal portion provides a low pressure seal during pressure build-up as the riser is extending.

8 Claims, 3 Drawing Sheets

SPRINKLER TO TOP RISER AND HOUSING SEAL CARTRIDGE FOR GEAR DRIVE SPRINKLER

CROSS-REFERENCE TO RELATED APPLICATIONS

This application is a continuation of U.S. application Ser. No. 11/438,621 filed on May 22, 2006 which is based on and claims priority to U.S. Provisional Application 60/682,994, filed May 20, 2005, the entire disclosure of which is incorporated herein by reference.

BACKGROUND

Gear drive sprinklers have a larger riser diameter than spray heads and the pressure load on the riser against the sprinkler housing top is much greater so that having the riser come up and seat against the rubber is undesirable. In my U.S. Pat. No. RE 35,037 I disclosed a gear driven sprinkler where the riser bottoms against the retraction spring when it is loaded up by the irrigation system pressure in the body can of the sprinkler. Also shown is a long cylindrical riser seal portion that extends down to seal to the riser at its bottom circumference when the sprinkler is in the up extended position.

U.S. Pat. No. 4,316,579 is a good summary of riser seal prior art.

One problem with known devices is that the soft rubber seal portion tends to lose dimensional stability over time, and then effectiveness of the seal deteriorates. Also known seals have not been completely effective as a low pressure seal to prevent blow-by while the sprinkler is being pressurized.

Thus, a need exists for an improved seal construction for sprinkler risers.

SUMMARY

The present invention seeks to satisfy the above described need by providing an improved seal construction in which an internally hard plastic core is molded into the rubber seal. This permits the less dimensionally stable rubber portion of the seal to retain the proper tolerances over time.

Also, with its hard core, the seal is configurable to provide a small downwardly angled low pressure seal to limit water blow-by during the sprinkler pressurizing phase and yet is soft and flexible enough to ensure minimum resistance during sprinkler riser retraction by the retraction spring when the water pressure is turned off.

The stack-up height of the retraction spring coils is such as to carry the high mechanical housing pressure load on the riser up against the sprinkler housing can top. A seal extension cylindrical portion extends downwardly and touches the riser on an upward flange portion of a spring carrier ring around the riser to provide a positive clamping seal to prevent leakage around the riser at high pressure. This clamp seal for high pressure allows the thin flexible lip portion of the riser seal to be thin and flexible since it does not have to seal against high pressure. The rubber portion of the seal cartridge are connected by channels so that a seal ring around the outside of the seal cartridge can provide the seal between the seal cartridge and the body can.

There is a step on the outside circumference of the seal cartridge to transmit the pressure load on the spring cartridge by the riser against the retraction spring and the seal seat position to the sprinkler housing can top.

Other features and advantages of the present invention will become apparent from the following description of the invention which refers to the accompanying drawings.

DETAILED DESCRIPTION OF THE EMBODIMENTS

Figure 1:
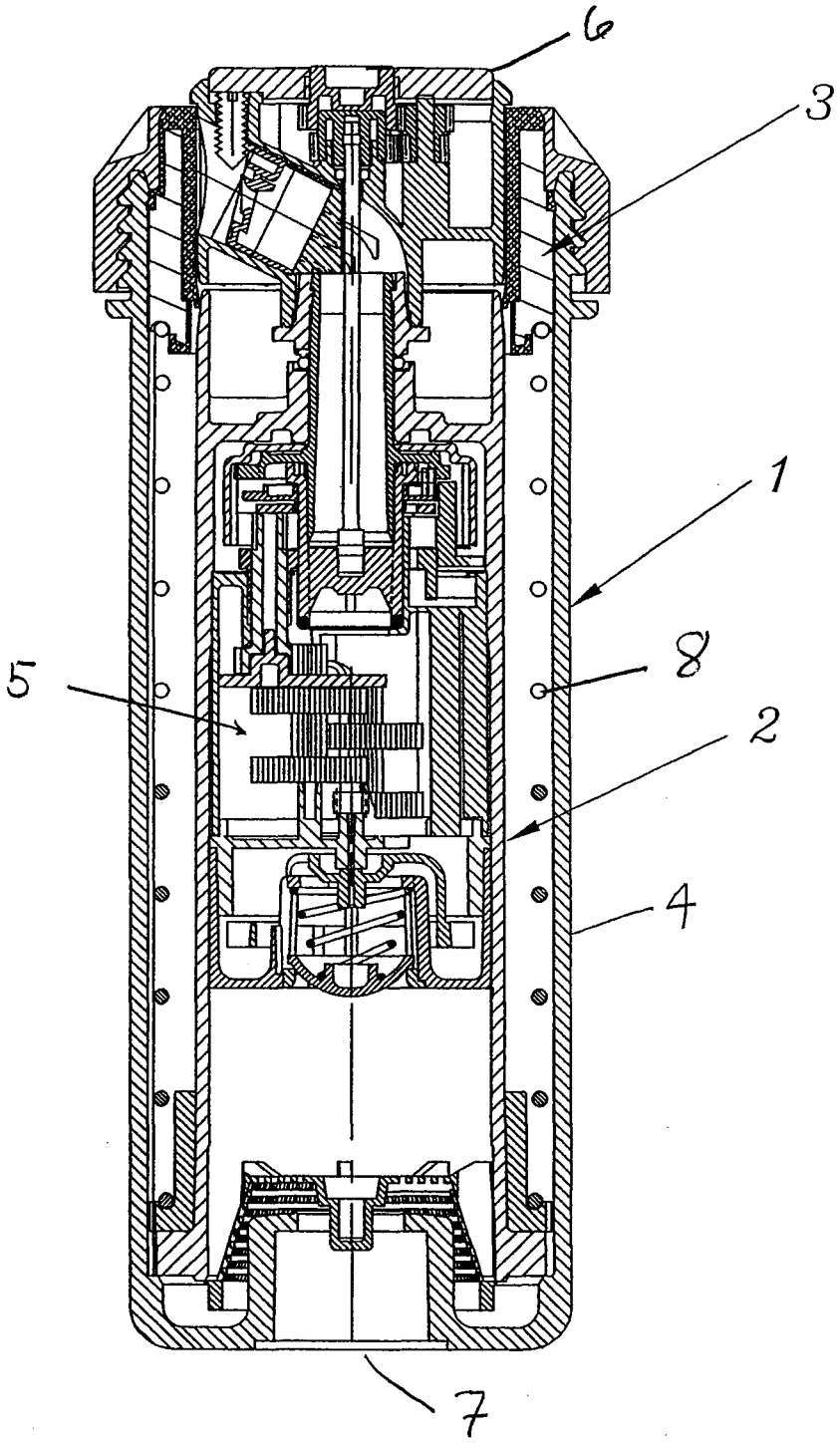
FIG. 1 shows a cross-section of a sprinkler riser housing seal cartridge according to the invention with the riser in the retracted position.
Figure 2:
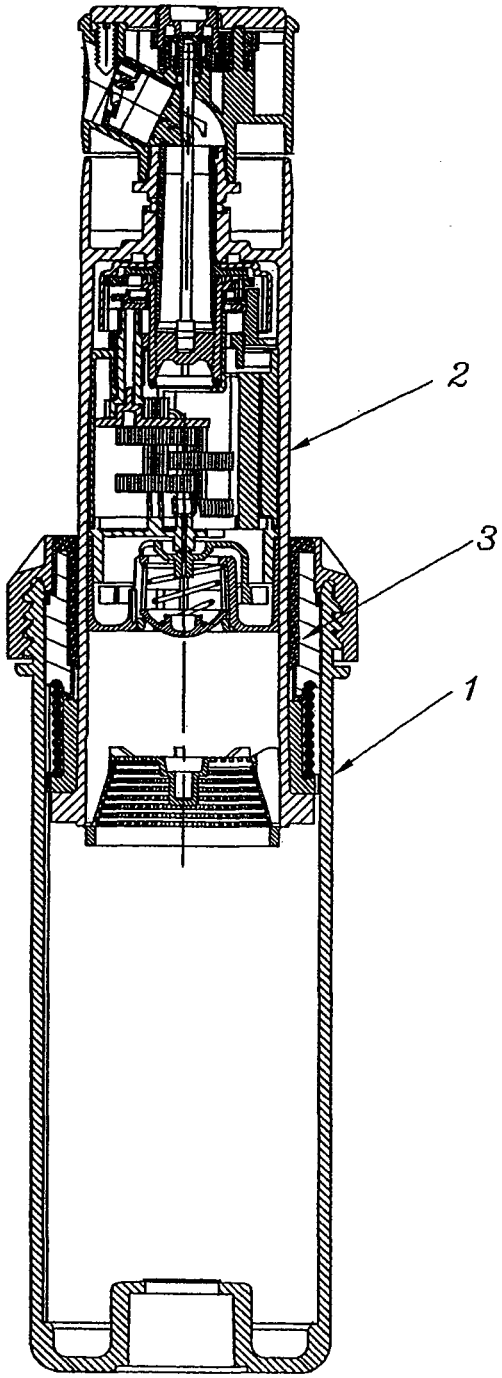
FIG. 2 shows a cross-section of the same sprinkler with the riser pressurized fully up with the riser seat on the spring and a portion of the riser seal also touching and sealing against the riser spring carrier ring.

FIG. 1 shows a cross section of a sprinkler 1 having an outer housing or body 4, a rotary drive mechanism 5, a riser 2, and a nozzle assembly 6 mounted at the top of riser 2. Here, riser 2 in the retracted position. FIG. 2 shows the same sprinkler with the riser 2 in its fully extended position resulting from compression of riser return spring 8 by the pressure of the water entering the sprinkler at its lower end 7.

Sprinkler 1 as illustrated is conventional, and its construction and operation are well known to those skilled in the art. The seal cartridge according to the invention, generally denoted at 3, is shown as used in sprinkler 1, and will be described in that context in detail in connection with FIG. 3. It is to be understood, however that this is exemplary, and only for purposes of illustration. The invention is directly applicable to any other sprinkler system which employs a riser.

Figure 3:
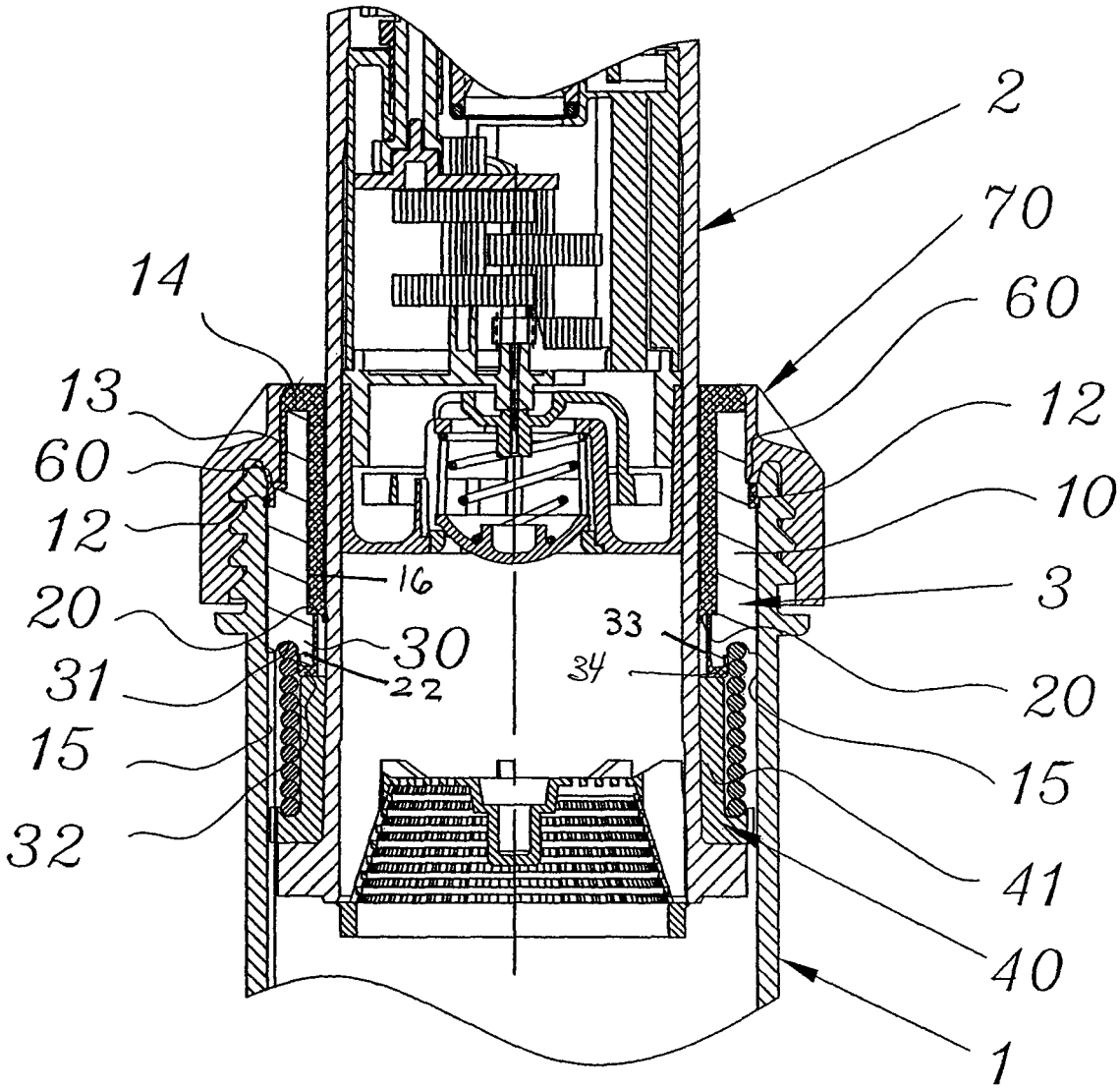
FIG. 3 is an enlarged partial cross section similar to FIG. 2 showing details of the seal cartridge.

Referring now to FIG. 3, only the portion of sprinkler 1 including seal cartridge 3, the associated portions of riser 2 and sprinkler housing 4 are shown. Seal cartridge 3 is comprised of a hard plastic outer shell 10 formed of ABS or any other material having similar properties, and a resilient circumferential ring 12 formed of a polyurethane material such as Pellthane® or an equivalent, around the outside of shell 10 which provide a resilient rubber seal to the sprinkler body housing inside surface 15. This ring 12 of resilient polyurethane material is bondable during molding to cartridge shell 10 and the ring 12 is fed during the co- or insert molding process by circumferentially spaced ribs 13 down from a resilient material ring 14 around the top of the seal cartridge to form an unitary structure with ring 12.

An inner surface seal, i.e., the portion which defines the inside diameter of the seal, can be formed by a tubular body 16 of resilient polyurethane material extending down from resilient ring 14 spaced radially inward from ribs 13, and bonded to the inner surface of shell 10. Shell 16 terminates at its lower end in a reduced diameter lip seal 20 which functions to prevent low-pressure blow-by during upward movement of riser 2.

Alternatively, the inner surface seal may be in the form of circumferentially spaced axial ribs positioned in grooves formed in the inner surface of shell 10. This can provide guidance and centering of riser 2 during the riser upward movement, and helps ensure the smaller lip seal 20 functions properly during the riser upward movement.

Extending downward from inner seal portion 16 radially outward from lip seal 20, is a cylindrical extension 22 of cartridge shell 10 in which is formed a support groove 31 for riser return spring 8. This is covered by resilient radial collar portion 32 connected to cylindrical inner seal portion 16 by a thin downwardly extending neck portion 33. Collar 32 is seated on the riser spring carrier ring 40 upper cylindrical portion 41 which is tight fitted to the riser around its bottom.

This resilient material 32 is fed during molding as a continuous thin cylinder of material or with multiple ribs from above down the inside of the seal cartridge hard shell 10 around the inside circumference.

The main feature of the seal cartridge is its thin lip seal cartridge to riser 20 which is flexible and allows easy riser retraction but adequate seal for the pressure (such as 7 to 10 p.s.i.) necessary to push the riser 2 full bottoming on the retraction spring 10 spring groove 30 and seal cartridge step 60 to the sprinkler body top 70.

This construction is very strong due to the hard nature of the shell plastic material and well able to carry hard forces during sprinkler system water hammer occurring where empty lines fill with water.

Good high pressure sealing is provided by slight compression of resilient collar 32 after assembly. The result of the illustrated construction is a durable and leak-free seal which provides long term reliability and smooth operation for the riser.

Although the present invention has been described in relation to particular embodiments thereof, many other variations and modifications and other uses will become apparent to those skilled in the art.

What is claimed is:

1. A riser seal cartridge for an irrigation sprinkler comprising:

a support shell formed of a rigid self support material; and a sealing member formed of a resilient material covering the shell in areas which provide sealing surfaces in a single integrated assembly to provide three seal elements including:

a first seal element configured and positioned to provide a first seal at a top end of a sprinkler body between the seal cartridge and the sprinkler body;

a second seal element configured and positioned to provide a second seal below the first seal element along an outer surface of a riser between the riser and the seal cartridge; and a third seal element which is connected to the first and second seal elements to form the integrated assembly and configured to form a positive high pressure seal with the riser when the riser is fully extended.

2. A riser seal cartridge according to claim 1, wherein the first seal element provides a high pressure seal to prevent leakage between the seal cartridge and the sprinkler body; and the second seal element provides a low pressure seal between the seal cartridge and the riser during pressure build-up as the riser is extending.

3. A riser seal cartridge according to claim 1, wherein the support shell includes a lower end portion for receiving the upper end of a riser retraction spring.

4. A riser seal cartridge according to claim 3, wherein the part of the third seal element includes a radially extending collar located along the bottom of the support shell lower end portion.

5. A riser seal cartridge according to claim 1, wherein the second seal element is in the form of a thin, downwardly extending lip.

6. A riser seal cartridge according to claim 1, wherein the second seal element is located radially inwardly.

7. A riser seal cartridge according to claim 1, wherein the radially extending collar around the seal cartridge is compressed upon assembly of the seal cartridge in a sprinkler.

8. A riser seal cartridge according to claim 1, wherein the second seal element is in the form of a thin, downwardly extending lip.

* * * * *